US012102885B2

(12) United States Patent
Husemeyer et al.

(10) Patent No.: US 12,102,885 B2
(45) Date of Patent: Oct. 1, 2024

(54) APPARATUS FOR AN INFLATABLE SPORTS BALL

(71) Applicant: Sportable Technologies Ltd., London (GB)

(72) Inventors: Peter J. A. Husemeyer, Tunbridge Wells (GB); Ryan Godolphin, Brentford (GB); Mickael Churet, London (GB); Ian Savage, Swineshead (GB); Paul Jenkins, Bexhill-on-Sea (GB)

(73) Assignee: Sportable Technologies Ltd., London (GB)

( * ) Notice: Subject to any disclaimer, the term of this patent is extended or adjusted under 35 U.S.C. 154(b) by 234 days.

(21) Appl. No.: 17/771,613

(22) PCT Filed: Oct. 23, 2020

(86) PCT No.: PCT/GB2020/052692
§ 371 (c)(1),
(2) Date: Apr. 25, 2022

(87) PCT Pub. No.: WO2021/079146
PCT Pub. Date: Apr. 29, 2021

(65) Prior Publication Data

US 2022/0401797 A1 Dec. 22, 2022

(30) Foreign Application Priority Data

Oct. 25, 2019 (GB) ..... 1915532

(51) Int. Cl.
*A63B 41/04* (2006.01)
*A63B 24/00* (2006.01)
(Continued)

(52) U.S. Cl.
CPC ..... *A63B 41/04* (2013.01); *A63B 24/0021* (2013.01); *A63B 41/085* (2013.01);
(Continued)

(58) Field of Classification Search
CPC ..... A63B 41/04; A63B 43/06; A63B 41/085; A63B 2220/833; A63B 2243/0025;
(Continued)

(56) References Cited

U.S. PATENT DOCUMENTS 4,577,865 A * 3/1986 Shishido ..... A63B 43/00 473/570
5,609,411 A * 3/1997 Wang ..... A63B 43/06 362/253

(Continued)

FOREIGN PATENT DOCUMENTS

CN 105101732 A * 11/2015 ..... A63B 41/085
CN 105854250 8/2016

(Continued)

OTHER PUBLICATIONS

International Search Report for PCT/GB2020/052692 dated Dec. 21, 2020.

*Primary Examiner* — Steven B Wong
(74) *Attorney, Agent, or Firm* — Christopher M. Scherer; DeWitt LLP

(57) ABSTRACT

An apparatus for permitting electrical connection between the exterior of an inflatable sports ball and electronics located inside the inflatable sports ball is provided. The apparatus comprises a support member, the support member having separate first and second through-holes provided therein for respectively connecting the exterior of the inflatable sports ball with the interior of the inflatable sports ball. An electrical connection port is located in the first through-hole of the support member for permitting an electrical
(Continued)

connection to be made through the first through-hole. An air valve is located in the second through-hole of the support member, the air valve comprising an aperture for selective communication of air.

17 Claims, 14 Drawing Sheets

(51) Int. Cl.
*A63B 41/08* (2006.01)
*A63B 43/06* (2006.01)

(52) U.S. Cl.
CPC ..... *A63B 43/06* (2013.01); *A63B 2024/0034* (2013.01); *A63B 2220/833* (2013.01); *A63B 2225/54* (2013.01); *A63B 2243/0025* (2013.01); *A63B 2243/0037* (2013.01); *A63B 2243/0066* (2013.01); *A63B 2243/007* (2013.01); *A63B 2243/0095* (2013.01)

(58) Field of Classification Search
CPC ..... A63B 24/0021; A63B 2024/0034; A63B 2225/54; A63B 2243/0037; A63B 2243/0066; A63B 2243/007; A63B 2243/0095
See application file for complete search history.

(56) References Cited

U.S. PATENT DOCUMENTS

| | | | | |
|---|---|---|---|---|
| 5,669,702 | A | 9/1997 | Wang | |
| 8,517,869 | B2 * | 8/2013 | Steidle | A63B 43/00 473/570 |
| 9,384,676 | B2 * | 7/2016 | Costain | A63B 41/00 |
| 9,586,099 | B2 * | 3/2017 | Holthouse | A63B 24/0021 |
| 10,076,685 | B2 * | 9/2018 | King | H02J 50/90 |
| 2003/0224885 | A1 * | 12/2003 | Leal | A63B 43/06 473/570 |
| 2007/0021244 | A1 * | 1/2007 | Ko | A63B 41/00 473/570 |
| 2007/0281811 | A1 * | 12/2007 | Wang | A63B 43/06 473/570 |
| 2010/0130316 | A1 | 5/2010 | Steidle | |
| 2012/0058845 | A1 * | 3/2012 | Crowley | A63B 41/00 206/522 |
| 2014/0031151 | A1 | 1/2014 | Crowley et al. | |
| 2016/0074714 | A1 * | 3/2016 | Krysiak | A63B 43/004 473/570 |
| 2018/0015333 | A1 * | 1/2018 | Binder | A63H 29/22 |
| 2018/0021630 | A1 | 1/2018 | Monnin et al. | |
| 2019/0305567 | A1 * | 10/2019 | Keeley | H02J 7/0013 |
| 2020/0391084 | A1 * | 12/2020 | Ianni | A63B 43/004 |

FOREIGN PATENT DOCUMENTS

| | | |
|---|---|---|
| EP | 1666916 | 6/2006 |
| EP | 2767314 | 8/2014 |
| GB | 2042136 | 9/1980 |
| WO | 2016175189 | 11/2016 |

* cited by examiner

APPARATUS FOR AN INFLATABLE SPORTS BALL

CROSS-REFERENCE TO RELATED APPLICATIONS

The present application is the U.S. National Stage application of International Application No. PCT/GB2020/052692, filed Oct. 23, 2020, which International Application was published on Apr. 29, 2021, as International Publication No. WO2021/079146. The International Application claims priority to British Patent Application No. 1915532.4, filed Oct. 25, 2019, the contents of which are incorporated herein by reference in their entireties.

FIELD OF THE INVENTION

The present invention relates to an apparatus for permitting electrical connection between the exterior of an inflatable sports ball and electronics located inside the inflatable sports ball, as well as inflatable sports balls containing such apparatuses. Such electrical connection may provide for data transfer with or charging of the electronics in the sports ball. In particular, the invention relates to an apparatus for permitting electrical connection between the exterior of a rugby ball and electronics located inside the rugby ball, such as for tracking the position and flight of the rugby ball.

BACKGROUND

There is a desire to be able to track sports balls, for example rugby balls, whilst they are in use either in training or in a match. This would be able to provide a number of important and interesting statistics for players and coaches. From a performance perspective, if players and coaches could track and understand how different training and techniques affect how the ball can be passed/kicked, it could provide a valuable insight into the best training methods, and give feedback on player technique, which in turn can lead to improvement in players' skills.

During matches, having knowledge of exactly where the ball is would be integral in developing a real-time virtual display of the ball during a game. This would give rise to being able to write programs to allow a match to be created in a virtual world which could be used for player/coach feedback or for TV analysis during broadcast. This data could also be used to recreate all/part of the game if the movement of the players was also tracked.

The most reliable ways of tracking sports balls requires electronics to be provided inside the ball. This poses a number of problems as regards communicating with the electronics inside the ball and charging the electronics inside the ball without compromising the exterior of the ball or the reliability of the electronics.

In some known cases, Inductive Charging systems have been provided inside the ball to allow for charging capabilities without altering the exterior of the ball and to minimise the number of changes needed to conventional manufacturing techniques for inflatable balls. These systems suffer from a number of drawbacks. In particular the charging coil can be brittle and prone to breaking, which is problematic for sports balls that are often subject to large forces, e.g. during kicking, the charging is often slow, inductive charging solutions are expensive, the charging is inefficient and importantly for flight and playability, they are heavy. To accomplish communication with the electronics inside the ball there are many wireless communication technologies available, such as Wi-Fi, Bluetooth and NFC. If the only method of communicating with the electronics inside the ball is through wireless communication technologies then the diagnostic and repair options are limited without destroying the ball to access the electronics. Furthermore, where there is only a wireless connection, diagnosing faults after manufacturing is significantly more difficult and results in a lower manufacture yield, which increases the effective cost per ball.

It is desired to provide a means for connecting with electronics inside an inflatable sports ball that does not suffer from the above problems, and which minimises the changes needed relative to conventional manufacturing techniques for inflatable sports balls. Furthermore, it is desirable to find a low-weight solution so that the impact on the flight dynamics and the playability of the ball are minimised.

SUMMARY OF THE INVENTION

In accordance with a first aspect of the present invention, there is provided an apparatus for permitting electrical connection between the exterior of an inflatable sports ball and electronics located inside the inflatable sports ball, the apparatus comprising: a support member, the support member having separate first and second through-holes provided therein for respectively connecting the exterior of the inflatable sports ball with the interior of the inflatable sports ball; an electrical connection port located in the first through-hole of the support member for permitting an electrical connection to be made through the first through-hole; and an air valve located in the second through-hole of the support member, the air valve comprising an aperture for selective communication of air. The present inventors have realised that a physical electrical connection port can be provided to an inflatable sports ball with minimal disruption to standard manufacturing techniques by adapting the valve supporting structure of the sports ball. In particular separate through-holes have been provided in the same structural support member to provide access respectively to an air valve and the electrical connection port in such a way that one does not impact the integrity of the other, and so that both can simultaneously be fitted to the sport ball in the same way a conventional valve structure would be fitted to the ball. This realisation has allowed the use of physical connection ports, which offer improvements in reliability and manufacturing yield owing to the physical ports being more robust than wireless charging systems. Furthermore, a physical port improves diagnostic capabilities of malfunctioning balls and enables an additional route for firmware updates to be supplied with greater fidelity. Charging and data transfer speeds are also improved. The present invention also makes the sports ball more user friendly in that both the air valve and the electrical connection port will be located in similar positions on the ball, meaning a user will be able to more quickly find and operate the electrical connection port.

As mentioned above, the apparatus comprises a support member having separate first and second through-holes. The second through-hole receives an air valve for inflating the sports ball. This may be a conventional air valve, as it will be unaffected by the presence of the accompanying electrical connection arrangement. This second through-hole may provide a compressive force to the air valve seated therein in order in order to form an air tight seal.

The first through-hole contains the electrical connection port. A user may thereby access the first through-hole from the exterior of the sports ball and plug in an appropriate cable to form a connection with electronics in the sports ball, said connection passing through the exterior cover of the sports ball via this through-hole.

While the present invention provides advantages over wireless data communication and charging, other wireless technologies can also be incorporated into the apparatus, such as NFC, e.g. attached to the support member, in order to provide the advantages of both systems.

Preferably, the support member is formed of a resilient material, such as natural rubber or synthetic rubber. This is advantageous for a number of reasons. Firstly, it enables the first and second apertures to resiliently deform around the elements inserted therein, i.e. the air valve and the connection port assembly, which helps form an air tight seal and helps to retain these elements in their proper through-holes. Secondly, the resilient support member will also be less prone to breaking during use, which could compromise the connection to the internal electronics.

In many embodiments, the first and second through-holes of the support member are defined by a single unitary element. For example, the first and second through-holes may be defined by a single piece of formed rubber. Again, this reduces potential break points in the support structure and reduces the chance that anything would compromise the integrity of the air tight valve arrangement or the seating of the electronic connection port.

Preferably, the first and/or second through-holes are substantially cylindrical through-holes and preferably these cylindrical through-holes are provided substantially parallel with one another. Cylindrical through-holes cooperate well with conventional air valves for sports balls and also cooperate well with the electrical connection assemblies disclosed herein.

A typical electrical connection port, such as a micro-USB port, will comprise metal connectors, and so it is imperative that player safety is maintained and that the electrical connection ports cannot come into direct contact with a player. Therefore, the electrical connection port is typically recessed into the first through-hole with respect to the exterior side of the first through-hole. Recessing the electrical connection port in the through-hole ensures that the port cannot directly contact a player, even if any cover for the port is lost or removed, e.g. during play.

A conventional valve arrangement may comprise a single through-hole that is connected to an inner inflatable bladder of a sports ball via a flange extending around the through-hole. An apparatus according to the present invention may provide that the support member comprises a peripheral flange encompassing the first and second through-holes for attaching the support member to an inner inflatable bladder of the inflatable sports ball and/or an outer cover of the inflatable sports ball. Here, the connecting flange is being made to encompass also the through-hole of the electrical connection port, so that the apparatus of the invention can be sealed to an inner inflatable bladder and/or an outer cover of the inflatable sports ball without requiring additional processing steps.

One particular challenge the present inventors faced was how to seat the electrical connection port in the first through-hole. The present inventors found that a preferred way to do this was to provide that the electrical connection port is carried by an electrical connector assembly adapted for insertion into the first through-hole, the electrical connector assembly comprising a plug member configured for insertion into the first through-hole, the plug member comprising an opening though which the electrical connection port is exposed inside the first through-hole. That is, the electrical connection port is provided in or on a plug member that is then inserted into the first through-hole from the interior side of the through-hole. This plug member helps form an air tight seal around the electrical connection port and also helps prevent the electrical connection port from passing entirely through first through-hole, which may endanger player safety.

Preferably, the plug member comprises a first face carrying the opening through which the electrical connection port is exposed inside the first through-hole, the first face being no larger than, preferably smaller than, (e.g. of a diameter less than or equal to the inner diameter of) the first through-hole, and a second face substantially opposite the first face, the second face being larger than the first through-hole (i.e. larger than the narrowest part of the through-hole) such that the plug member cannot pass through the first through-hole. Here, the plug member is shaped such that the rear face of the plug prevents it from passing through the first through-hole, which increases player safety and prevents dislocation of the connection port. The rear face of the plug being larger than the first through-hole also helps adhere the plug to the first through-hole. While preferable, it would also be possible for the plug to be formed to match exactly the interior profile of the first through-hole.

Preferably, the plug member comprises tapering sidewalls for engaging the inside walls of the first through-hole, the sidewalls tapering outward as they extend away from the opening though which the electrical connection port is exposed. For example, the plug member may be substantially frustum shaped, preferably frustoconical. This arrangement provides advantages in that tapering or conical sidewalls will fit various sizes of through-hole to allow for manufacturing tolerances in the sizing of the first through-hole or the plug itself. Furthermore, the tapering sidewall will again prevent the plug and hence the connection port from passing through the first through-hole, which would endanger the safety of the players.

Another important aspect of the electrical connection port assembly is that there is a need for good adhesion between the plug and the first through-hole to prevent dislocation. Preferably, the plug member comprises sidewalls (which will typically be tapered or conical) for engaging the inside walls of the first through-hole, said sidewalls comprising one or more grooves for receiving adhesive to promote adhesion of the plug member to said inside walls of the first through-hole. Preferably the profile of the plug member will substantially correspond to the dimensions of the first through hole. Typically, the electrical connector assembly will be fixed to the support member by gluing the plug member into the first through-hole. However, it has been found by the inventors that a plug with flat sidewalls will typically have much of its adhesive stripped as it is pressed into the first through-hole. The present inventors found that providing one or more grooves in the sidewalls of the plug member enabled it to retain more adhesive and so form a firmer connection with the inside surface of the first through-hole. Again, this improves reliability of the apparatus.

Preferably, one or more grooves in the plug sidewalls extend around substantially the entire periphery of the plug member sidewalls, and more preferably the one or more grooves define one or more helical grooves extending around substantially the entire periphery of the plug member sidewalls. This ensures that a firm connection is made between the periphery of the plug member and the inside surface of the first through-hole.

The electrical connection port itself will typically be a standard port type, such as micro-USB, to facilitate user connection. However, it is necessary to adapt or integrate one of these standard ports into the connector assembly used here. The inventors have found two options for doing this. In one option, the plug member is provided as an integral jacket of the electrical connection port, and in the second option, the plug member is provided as a transition piece into which the electrical connection port is inserted. In the first option, the electrical connection port is overformed (i.e. over-moulded) with a preferably unitary jacket defining the plug member. The connection port and plug member may thereby be unitary. Alternatively, the plug member may be separately formed as a transition piece, and a bare electrical connection port inserted into this transition piece as part of the assembly process.

In order to produce the final apparatus, the electrical connector assembly may be arranged in the first through-hole (e.g. it may be inserted into the first through-hole with adhesive to fix it to the inside wall of the first through-hole) and backfilled with a sealant to provide an air-tight seal of the first through-hole. A suitable sealant that may be used to backfill the electrical connector assembly when inserted into the first through-hole would be an epoxy adhesive.

Preferably, the apparatus comprises one or more visual indicators, preferably lights such as LEDs, located in the first through-hole for conveying information, for example, as regards data transfer with and/or charging of electronics located inside the inflatable sports ball, or the status of a connection to a wireless network. One particularly preferable way that this may be achieved is by providing that the visual indicators are carried by the plug member of the electrical connector assembly. That is, one or more LEDs may be provided surrounding the electrical connector port, exposed through the face of the plug member. These LEDs would also connect via the electrical connector assembly to the electronics of the sports ball.

In most embodiments, the apparatus will further comprise wiring extending from the electrical connection port for connecting the electrical connection port to electronics located inside the sports ball. Where the electrical connection port is carried on an electrical connector assembly, this wiring will typically extend from the rear of the plug member into the interior of the sports ball. While preferable it would be possible for the connector port to be directly connected to, e.g. a circuit board of the electronics.

As mentioned above, the electrical connection port preferably comprises a USB port, preferably a mini-USB port, a micro-USB port, or a USB Type-C port. While preferable, any physical connection port will offer the advantages of the present invention.

Another important consideration of the present apparatus is that it is preferred if the connection port can be shielded from ingress of foreign materials, such as water and dirt. This may involve any sort of capping mechanism, e.g. a threaded cap that screws into the exterior side of the first through-hole. However, preferably, the first through-hole connects to a resilient collar on the exterior side of the first through-hole, and wherein the apparatus further comprises a bung for inserting into the resilient collar so as to prevent ingress of materials into the electrical connection port. Preferably the bung is also resilient. The resilient collar may be integrally formed with the support member, e.g. formed of the same unitary element so that it is an extension of the first through hole, or it may be provided by an attachment to or over the first through hole. Furthermore, it is important that the sealing arrangement makes the apparatus safe. The bung and collar should be soft so that they do not hurt a player who comes into contact with the housing of the charging port, e.g. by kicking it. This arrangement has been found to offer a particularly good combination of a tight seal for preventing ingress of materials while also being soft so that the capping mechanism cannot injure players. Furthermore, the capping mechanism covers the connection port so that this cannot come into contact with and injure the players.

Particularly preferably, the bung comprises a bulbous end for insertion into the resilient collar, the bulbous end thereby causing the opening of the resilient collar to tighten around the bung. That is, the resilient collar may be substantially cylindrical, and the bung may have a lower portion wider than the inner diameter of the resilient collar. When this bung is inserted into the collar, it presses the collar outwards, which causes it to constrict on either side of the wide portion of the bung. This securely holds the bung in place in the resilient collar.

In some embodiments the bung comprises a slot in its exterior surface, i.e. the outer facing surface of the cap element of the bung. This aids in removal of the bung from the collar. Alternatively, or in addition, the exterior surface of the bung may match the appearance of the inflatable sports ball.

Many embodiments further comprise a battery located on the support member. The battery is preferably located on the support member such that it is held inside the sports ball once the apparatus is incorporated into the sports ball. The battery may supply power to any electronics located in the sports ball. Preferably, the battery is electrically connected to the electrical connection port such that the battery may be charged via the electrical connection port. In alternative embodiments, the battery could be located elsewhere in the sports ball, such as on the inside face of the sports ball opposite to the support member.

Preferably, the battery is located adjacent to both the first and second through-holes. For example, a first end of the battery may be adjacent to the first through-hole and a second end of the battery adjacent to the second through-hole. This arrangement is preferred to an arrangement in which one through-hole is arranged between the battery and the other through-hole, since generally it provides a greater surface area of the support member for the battery to be mounted to.

Particularly preferably, the support member defines at least a first supporting wall and a second supporting wall, the first and second supporting walls supporting first and second faces of the battery. That is, the battery may be at least partially enclosed by the support member. Preferably the first and second supporting walls support the two largest faces of the battery. Preferably one of the first and second supporting walls is defined by a part of the support member defining the first and second through-holes. The supporting walls allow the battery to be firmly secured to the support member. For example, the battery may be adhered to the support member and adhering on multiple faces of the battery may provide a stronger adhesion. In a particularly preferred embodiment, the support member comprises a pocket in which the battery is located. For example, the battery may be enclosed by the pocket of the support member on all but one of its sides or faces. Preferably the pocket and the first and second through-holes of the support member are defined by a single unitary element. For example, the support member and pocket may be formed by a single piece of rubber or injection moulded as a single unit.

According to a second aspect of the invention, there is also provided an inflatable sports ball comprising: an outer cover defining the exterior of the inflatable sports ball; electronics located inside the outer cover; and the apparatus according to the first aspect of the invention adapted to permit electrical connection between the exterior of the inflatable sports ball and the electronics located inside the outer cover. That is, here we have the apparatus of the first aspect of the invention installed into an inflatable sports ball.

The inflatable sports ball may be any type of sports ball and is preferably one of: a rugby ball, an American football, an association football, a basketball, a netball or a volley ball.

While it is possible that the outer cover itself could be inflatable, typically the sports ball will further comprise an inner inflatable bladder encased in the outer cover and configured to be inflated through the air valve, wherein the electronics are located inside the inner inflatable bladder. In which case, typically, the inner inflatable bladder will be sealed around the periphery of the support member such that both the first and second through-holes connect into the interior of the inner inflatable bladder.

It should be noted that having electronics inside the bladder is advantageous because it protects the electronics and allows the electronics to measure the air pressure inside the ball.

The present apparatus may be used with many different types of electronics that could be incorporated into a sports ball. Preferably, the electronics comprise MEMS sensors, which may include inertial measuring units (IMUs) such as a 3D gyroscope, a 3D accelerometer, as well as a 3D magnetometer, a pressure sensor, a thermometer, a humidity sensor, and a microphone. Additionally, other electronics may be included such as a microcontroller, flash memory, power management, battery monitoring and wireless communication technologies such as Wi-Fi, Cellular, Bluetooth, NFC, UWB and alternative locating technologies such as RFID and GNSS.

According to a third aspect of the present invention, there is provided an apparatus for permitting electrical connection between the exterior of an inflatable sports ball and electronics located inside the inflatable sports ball, the apparatus comprising: a support member, the support member having a first through-hole provided therein for connecting the exterior of the inflatable sports ball with the interior of the inflatable sports ball; an electrical connection port located in the first through-hole of the support member for permitting an electrical connection to be made through the first through-hole; wherein, the electrical connection port is carried by an electrical connector assembly adapted for insertion into the first through-hole, the electrical connector assembly comprising a plug member configured for insertion into the first through-hole, the plug member comprising an opening though which the electrical connection port is exposed inside the first through-hole.

In contrast with the first aspect of the invention, this apparatus is dedicated solely to providing a connection port for electronics and does not also provide the air valve of the inflatable sports ball. This may be preferred where it is desirable to separate the electronic connection port from the air valve, e.g. for better weigh distribution within the ball.

In this aspect of the present invention, the electrical connection port is provided by an electrical connector assembly comprising a plug member that is inserted into the first through-hole. The advantages of this arrangement have been described above with respect to the first aspect of the invention, for which this features was a preferred implementation.

As above, while the present invention provides advantages over wireless data communication and charging, wireless communication such as an NFC unit could also be incorporated into the apparatus, e.g. attached to the support member, in order to provide the advantages of both systems.

Again, preferably, the support member is formed of a resilient material, such as natural rubber or synthetic rubber, as this enables the first aperture to resiliently deform around the plug member inserted therein, which helps form an air tight seal and helps to retain the plug member and prevent breakage.

In many embodiments, the first through-hole of the support member is defined by a single unitary element. Again, this reduces potential break points in the support structure and reduces the chance that anything would compromise the integrity of the location of the electronic connection port.

Preferably, the first through-hole is substantially cylindrical as this cooperates well with the electrical connection assembly according to this aspect.

Again, preferably, the electrical connection port is recessed into the first through-hole with respect to the exterior side of the first through-hole. Recessing the electrical connection port in the through-hole ensures that the port cannot directly contact a player, even if any cover for the port is lost or removed, e.g. during play.

An apparatus according to this aspect may provide that the support member comprises a peripheral flange encompassing the first through-hole for attaching the support member to an inner inflatable bladder of the inflatable sports ball and/or an outer cover of the inflatable sports ball. This apparatus may therefore be inserted into a sports ball using conventional techniques.

Preferably, the plug member comprises a first face carrying the opening through which the electrical connection port is exposed inside the first through-hole, the first face being smaller than the first through-hole, and a second face substantially opposite the first face, the second face being larger than the first through-hole (i.e. larger than the narrowest part of the through-hole) such that the plug member cannot pass through the first through-hole. Here, the plug member is shaped such that the rear face of the plug prevents it from passing through the first through-hole, which increases player safety and prevents dislocation of the connection port. The rear face of the plug being larger than the first through-hole also helps adhere the plug to the first through-hole. While preferable, it would also be possible for the plug to be formed to match exactly the interior profile of the first through-hole.

Preferably, the plug member comprises tapering sidewalls for engaging the inside walls of the first through-hole, the sidewalls tapering outward as they extend away from the opening though which the electrical connection port is exposed. For example, the plug member may be substantially frustum shaped, preferably frustoconical. As explained above, this arrangement provides advantages in that tapering or conical sidewalls will fit various sizes of through-hole to allow for manufacturing tolerances in the sizing of the first through-hole or the plug itself. Furthermore, the tapering sidewall will again prevent the plug and hence the connection port from passing through the first through-hole, which would endanger the safety of the players.

Again, preferably, the plug member comprises sidewalls (which will typically be tapered or conical) for engaging the inside walls of the first through-hole, said sidewalls comprising one or more grooves for receiving adhesive to promote adhesion of the plug member to said inside walls of the first through-hole. As explained above, this enables the plug to retain more adhesive and so form a firmer connection with the inside surface of the first through-hole.

Preferably, one or more grooves in the plug sidewalls extend around substantially the entire periphery of the plug member sidewalls, and more preferably the one or more grooves define one or more helical grooves extending around substantially the entire periphery of the plug member sidewalls. This ensures that a firm connection is made between the periphery of the plug member and the inside surface of the first through-hole.

As explained above, the plug member may either be provided as an integral jacket of the electrical connection port, or the plug member may be provided as a transition piece into which the electrical connection port is inserted.

In order to produce the final apparatus, the electrical connector assembly may be arranged in the first through-hole (e.g. it may be inserted into the first through-hole with adhesive to fix it to the inside wall of the first through-hole) and backfilled with a sealant to provide an air-tight seal of the first through-hole. A suitable sealant that may be used to backfill the electrical connector assembly when inserted into the first through-hole would be an epoxy adhesive.

Preferably, the apparatus comprises one or more visual indicators, preferably lights such as LEDs, located in the first through-hole for conveying information, for example, as regards data transfer with and/or charging of electronics located inside the inflatable sports ball and/or status of a wireless network connection. One particularly preferable way that this may be achieved is by providing that the visual indicators are carried by the plug member of the electrical connector assembly.

In most embodiments, the apparatus will further comprise wiring extending from the electrical connection port for connecting the electrical connection port to electronics located inside the sports ball. This wiring will typically extend from the rear of the plug member into the interior of the sports ball. While preferable it would be possible for the connector port to be directly connected to, e.g. a circuit board of the electronics.

As mentioned above, the electrical connection port preferably comprises a USB port, preferably a mini-USB port, a micro-USB port, or a USB Type-C port.

For the same reasons described above the preferable sealing arrangement comprises the first through-hole connecting to a resilient collar on the exterior side of the first through-hole, and wherein the apparatus further comprises a bung for inserting into the resilient collar so as to prevent ingress of materials into the electrical connection port. Particularly preferably, the bung comprises a bulbous end for insertion into the resilient collar, the bulbous end thereby causing the opening of the resilient collar to tighten around the bung, as explained above.

As with the first aspect of the invention, many embodiments further comprise a battery located on the support member. The battery is preferably located on the support member such that it is held inside the sports ball once the apparatus is incorporated into the sports ball. The battery may supply power to any electronics located in the sports ball. Preferably, the battery is electrically connected to the electrical connection port such that the battery may be charged via the electrical connection port. In alternative embodiments, the battery could be located elsewhere in the sports ball, such as on the inside face of the sports ball opposite to the support member.

Particularly preferably, the support member defines at least a first supporting wall and a second supporting wall, the first and second supporting walls supporting first and second faces of the battery. That is, the battery may be at least partially enclosed by the support member. Preferably the first and second supporting walls support the two largest faces of the battery. The supporting walls allow the battery to be firmly secured to the support member. For example, the battery may be adhered to the support member and adhering on multiple faces of the battery may provide a stronger adhesion. In a particularly preferred embodiment, the support member comprises a pocket in which the battery is located. For example, the battery may be enclosed by the pocket of the support member on all but one of its sides or faces. Preferably the pocket and the rest of the support member are defined by a single unitary element. For example, the support member and pocket may be formed by a single piece of rubber or injection moulded as a single unit.

According to a forth aspect of the invention, there is provided an inflatable sports ball comprising: an outer cover defining the exterior of the inflatable sports ball; electronics located inside the outer cover; and the apparatus according to the third aspect of the invention adapted to permit electrical connection between the exterior of the inflatable sports ball and the electronics located inside the outer cover.

As set out above, the inflatable sports ball may be any type of sports ball and is preferably one of: a rugby ball, an American football, an association football, a basketball, a netball or a volley ball.

The sports ball will typically further comprise an inner inflatable bladder encased in the outer cover and configured to be inflated through a separately provided air valve, wherein the electronics are located inside the inner inflatable bladder. In this case, typically, the inner inflatable bladder will be sealed around the periphery of the support member such that both the first through-hole connect into the interior of the inner inflatable bladder. At a separate location, the inner inflatable bladder may be sealed around a support member of an air valve structure, which will thereby provide the connection for inflating the sports ball.

The present apparatus may be used with many different types of electronics that could be incorporated into a sports ball. Preferably, the electronics comprise MEMS sensors, which may include inertial measuring units (IMUs) such as a 3D gyroscope, a 3D accelerometer, as well as a 3D magnetometer, a pressure sensor, a thermometer, a humidity sensor, and a microphone. Additionally, other electronics may be included such as a microcontroller, flash memory, power management, battery monitoring and wireless communication technologies such as Wi-Fi, Cellular, Bluetooth, NFC, UWB and alternative locating technologies such as RFID and GNSS.

BRIEF DESCRIPTION OF THE DRAWINGS

Examples of the disclosure will now be described, by way of example only, with reference to the accompanying drawings in which:

FIG. 3*d* shows a top view of the apparatus of the present invention with the bung removed so that the electronic connection port is visible;

DETAILED DESCRIPTION

Figure 1:
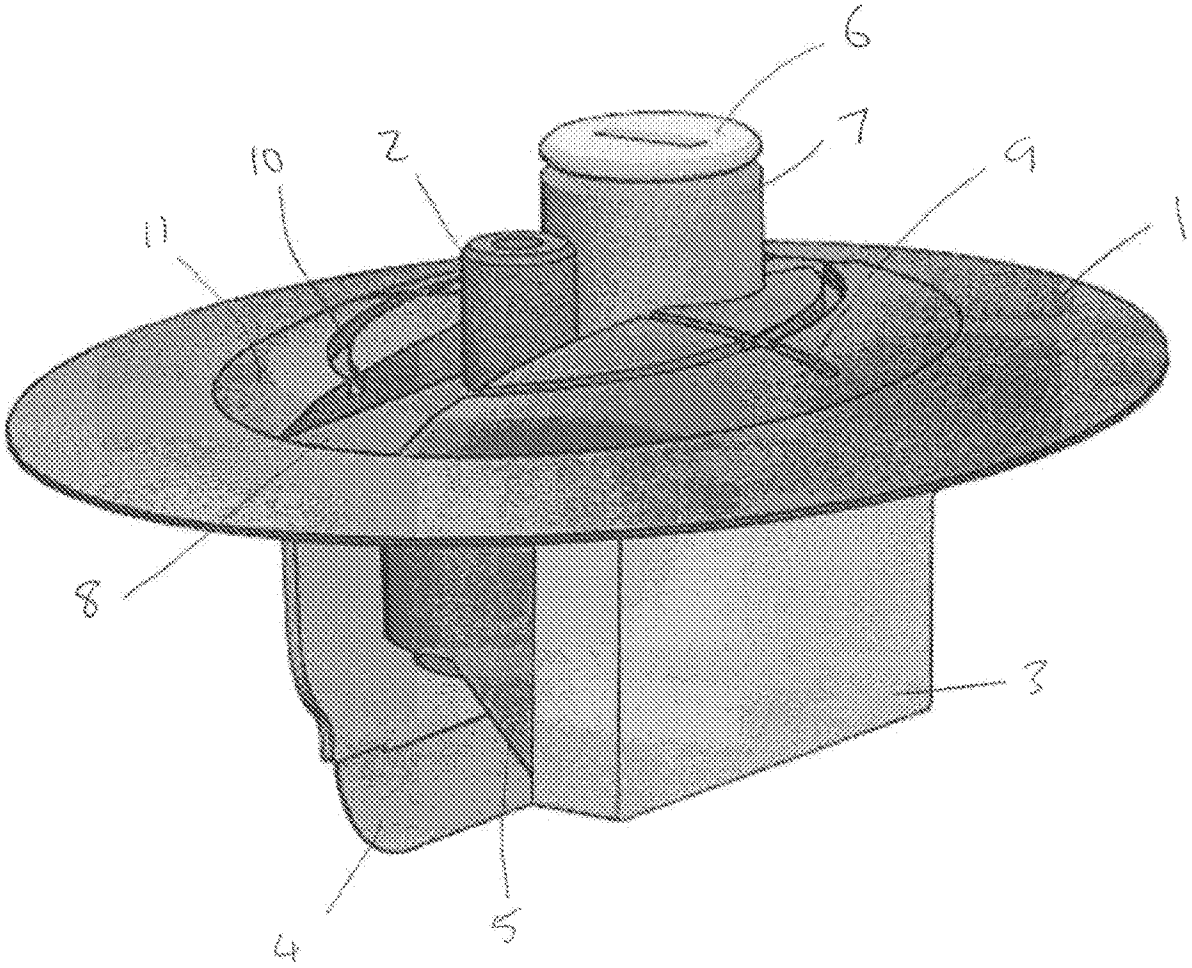
FIG. 1 shows a perspective view of the top of the apparatus of the present invention.

FIG. 1 shows a perspective view of a plate comprising the apparatus according to the invention. The plate 1 has a valve 25 which is accessed via valve access port 2 that extends away from the plate. The apparatus additionally comprises a battery 3, a circuit board 4 connected to the battery (connection not shown in this figure) and a support member 5 for connecting the battery 3 and the circuit board 4 and supporting the air valve 25 and electrical connection port 27. The electrical connection port 27 is accessible through the opening defined by the resilient collar 7 and is usable to charge the battery 3 and for providing data transmissions to the circuit board.

In the present example, the plate 1 comprises an extruded portion 11 which extends from the surface of the plate 1. A first elongate groove 8 extends along the length of the extruded portion 11. In the present example, the depth of the groove is such that it extends to the surface of the plate 1. This can be seen later in FIG. 3*b*.

The plate 1 additionally comprises a second elongate groove 9 extending substantially perpendicularly to the first elongate groove 8 along a portion of the width of the extruded portion 11. A third groove 10 may also be incorporated into the extruded portion. The third groove 10 may be substantially oval shaped and follow the shape of the extruded portion 11. These grooves are discussed further with respect to FIG. 3.

Figure 2:
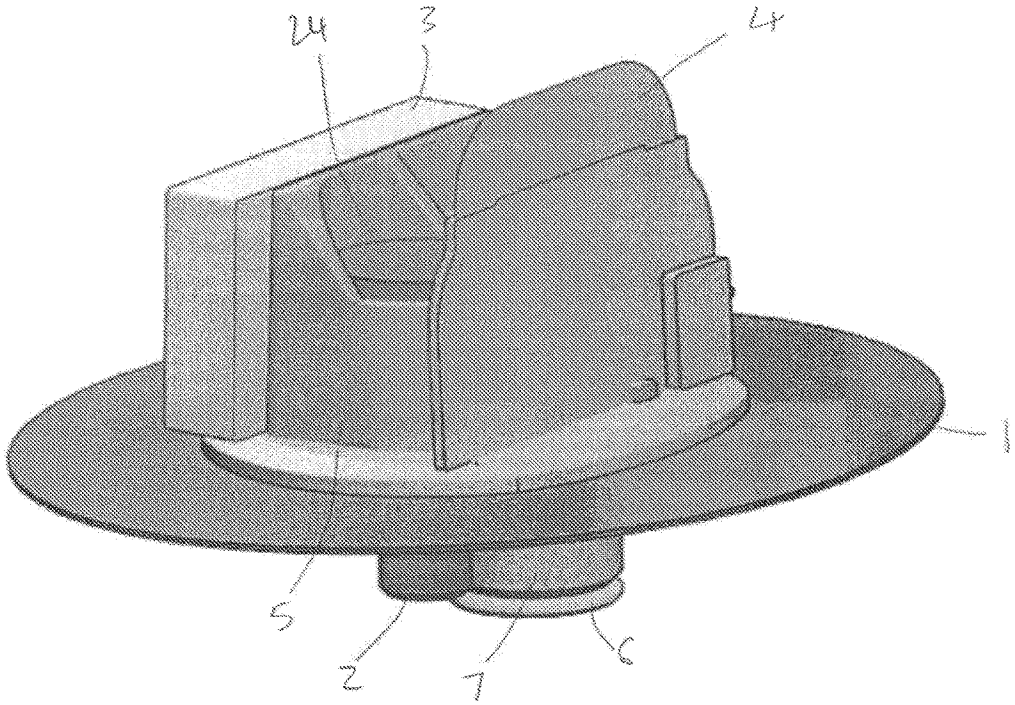
FIG. 2 shows a perspective view of the bottom of the apparatus of the present invention.

FIG. 2 shows a perspective view of the bottom of the apparatus of the invention. The support member 5 may be attached to the flattened lower surface (i.e. the opposite surface to that on which the extruded portion 11 is formed) of the plate 1 by glue. The battery 3 and the circuit board 4 are located on either side of the support member 5 in order to balance the weight of the apparatus. Furthermore, this provides the maximum surface area for adhesion between the support member 5 and the battery 3/circuit board 4. The battery is preferably located inside a pocket formed by the support member 5. That is, the support member 5 may define five supporting walls for supporting five faces of a cuboidal battery. One face of the battery may be left exposed, e.g. for an electrical connection to the battery. This face may correspond to the opening of the pocket into which the battery is inserted when assembling the apparatus. As can be seen from FIG. 2, a lip 24 of the valve extends outside the second through-hole 16 of the support member 5. This is discussed further later with respect to the other figures.

Inflatable balls such as rugby balls comprise an inner, inflatable bladder and an outer cover covering the bladder. When the apparatus is installed in a ball, for example a rugby ball, the lower surface of the plate shown in FIG. 2 is fixably attached to an outer surface of the bladder. For example, the plate may be attached to the outer surface of the bladder with adhesive. The battery 3, the circuit board 4 and the support member 5 which extend from the lower surface of the plate 1 protrude into an internal area of the bladder through a hole in the surface of the bladder. Thus, when the bladder is inflated via the valve, the air which enters into the valve exits into the internal space inside the bladder.

Figures 3, 3A:
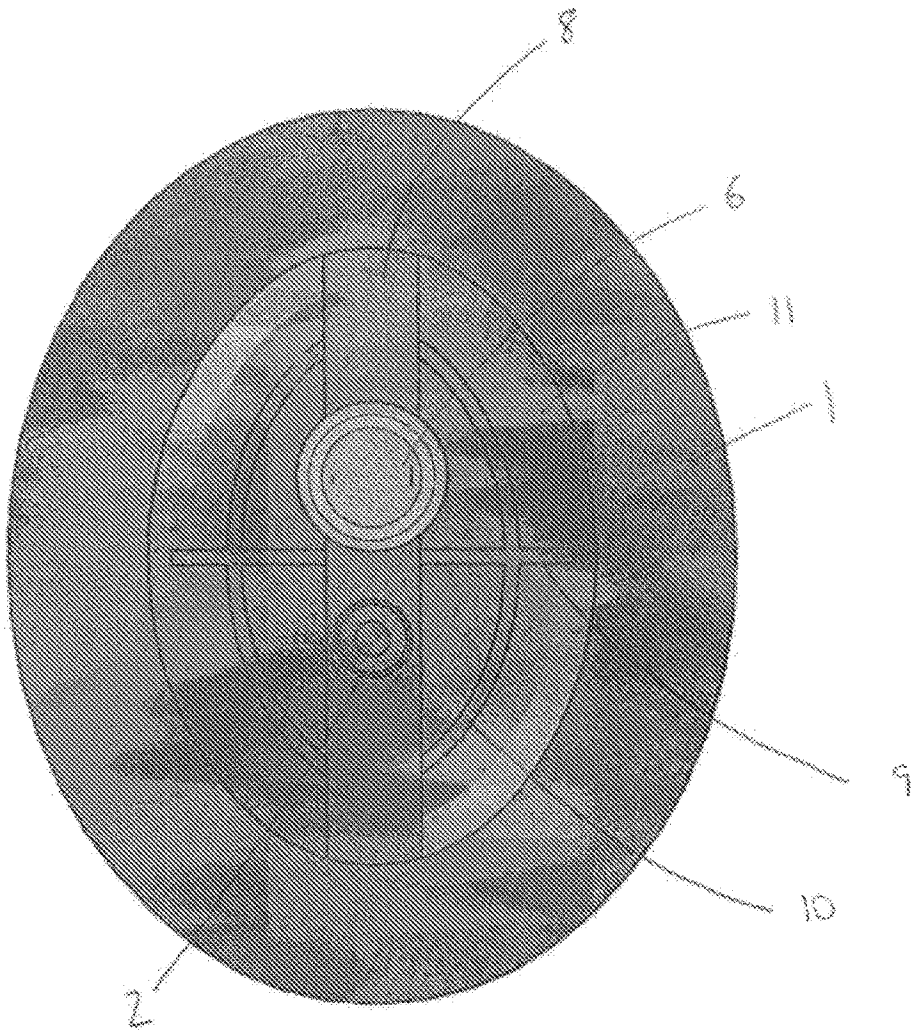
FIG. 3*a* shows a top view of the apparatus of the present invention.

FIG. 3*a* shows a top view of the apparatus of the present invention. As can be seen from this figure, the plate 1 has a substantially oval shape. In other examples, the plate 1 may have a circular or other shape.

In the present example, the extruded portion 11 has substantially the same shape as the plate 1 and is located in the centre of the plate 1.

The plate is sized in order to prevent air escaping from the bladder when the plate is attached to the bladder and the battery 3, the circuit board 4 and the support member 5 into the internal space defined by the bladder. For example, the plate may be approximately 90 mm in length and 73 mm in width. The extruded portion may be approximately 62.5 mm in length and 45 mm in width. The second elongate groove 9 extends across substantially the entire width of the extruded portion 11.

The grooves 8, 9 and 10 reduce the weight of the apparatus as well as improving the flexibility of the apparatus. This is important for when the apparatus is installed in an inflatable ball as the plate is able to deform when forces are exerted on the ball (for example when the ball is kicked). Furthermore, the extruded portion 11 increases the strength of the apparatus near the more delicate parts within the ball such as the circuit board.

Figure 3B:
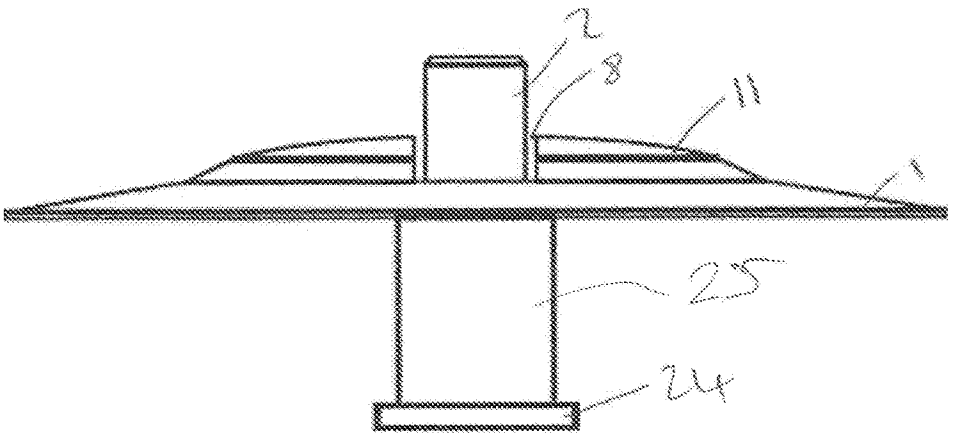
FIGS. 3*b* and 3*c* show an end view and a side view respectively of the plate and valve of the present invention.
Figure 3C:
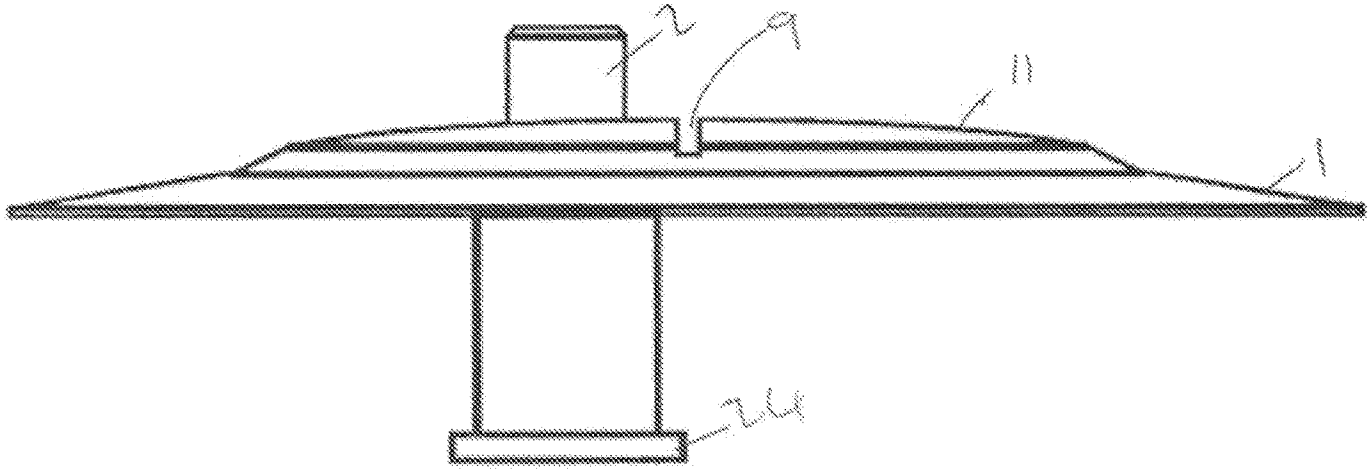
Figure 3B:
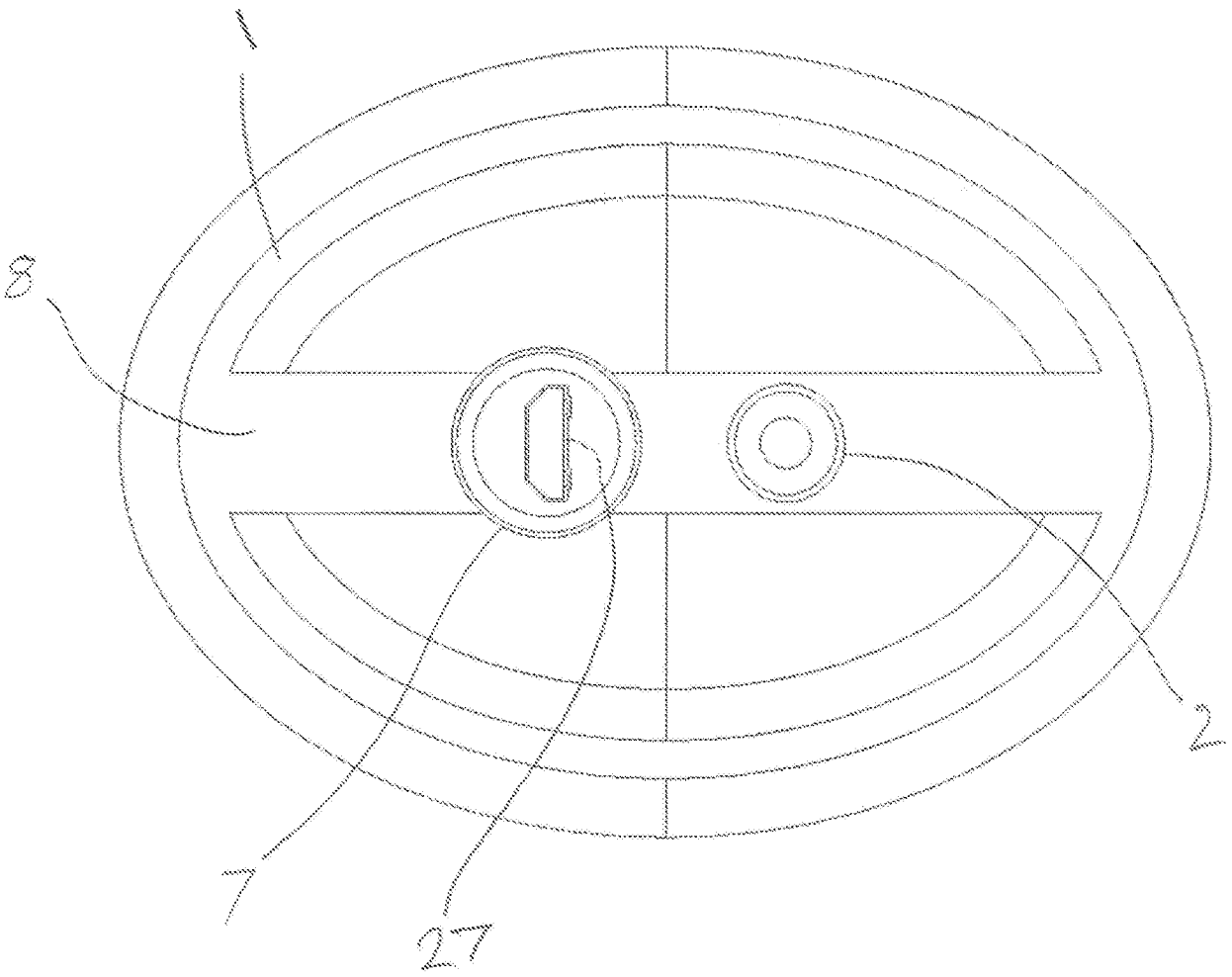

FIGS. 3*b* and 3*c* show the plate 1 and valve access port 2 in cross section. FIG. 3*b* shows the valve located in the first elongate groove 8 and FIG. 3*c* shows a cross sectional view of the second elongate grove 9 formed in the extruded portion 11. A cross-sectional view of the lip 24 of the valve 2 can also be seen from these figures. The lip 24 in the present example has a greater cross-sectional area than the rest of the valve. The lip 24 of the valve comprises a slit (not shown). This is to allow air to be forced into the ball when the apparatus is installed in a ball and the ball is being pumped up.

As can be seen from the cross sectional views of FIGS. 3*b* and 3*c*, the plate of the present example has a curved profile when viewed in cross section. Thus, in this way when the apparatus is installed in a ball and the ball is inflated, the plate substantially aligns with the curved surface of the ball and does not alter the shape of or protrude from the curved surface of the ball.

FIG. 3*d* shows another top view of the apparatus, but in this case the bung 6 that is usually inserted into the resilient collar 7 in order to close off the port from the environment is removed so that the connection port 27, in this case a micro-USB port, is visible.

In the present example, the plate is made of rubber. In other examples, different materials may be used.

Figure 4:
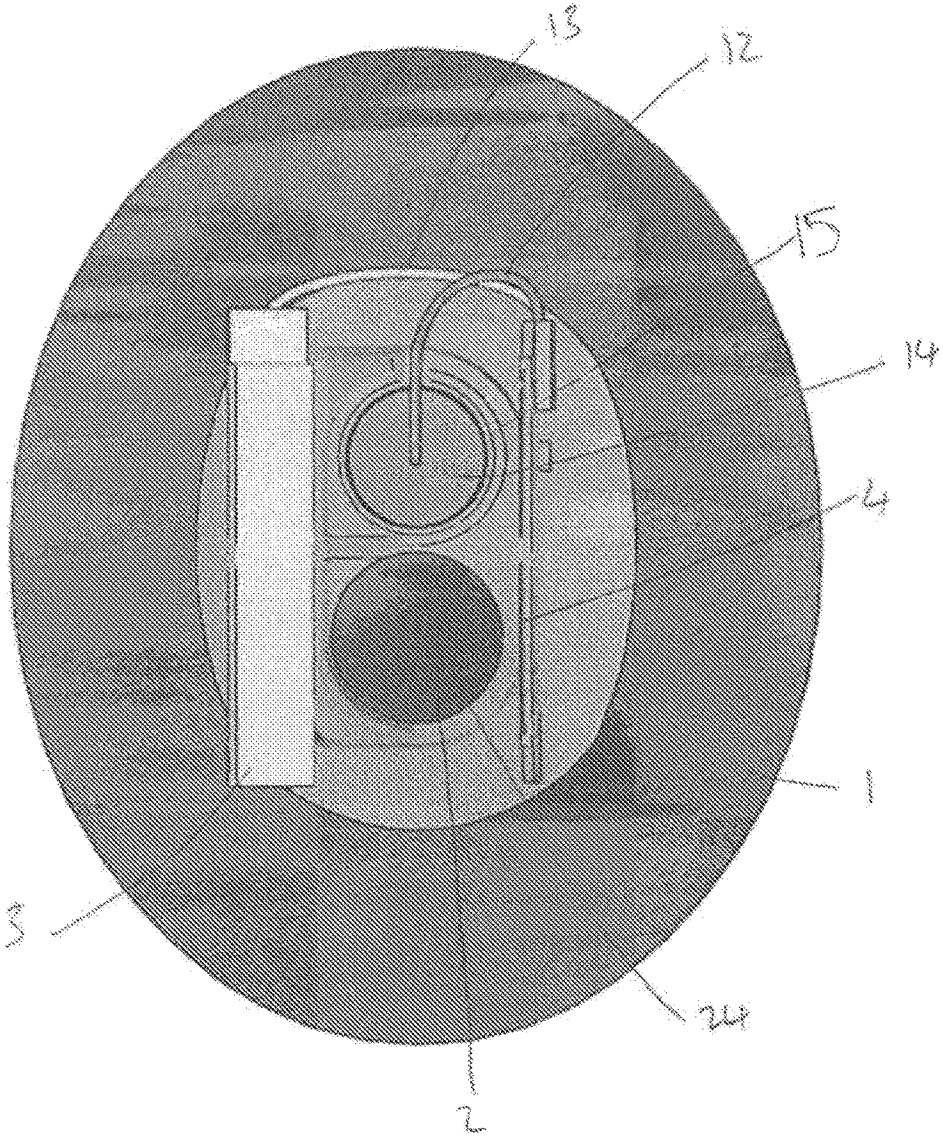
FIG. 4 shows a bottom view of the apparatus of the present invention.

FIG. 4 shows a bottom view of the apparatus. A plug member 14 carrying the electrical connection port sits within the first through-hole 15. Attached to the plug member 14 is an end of a first wire 12. The other end of the wire 12 is attached to the circuit board 4. A second wire 13 has a first end attached to the battery 3 and a second end also attached to the circuit board 4. As a result of the wire connections 12, 13 between the electrical connection port 27, battery 3 and circuit board 4, power can be provided from the port (when connected to a power source) to charge the battery 3 and to provide software updates to the circuit board 4.

Figures 5, 5A:
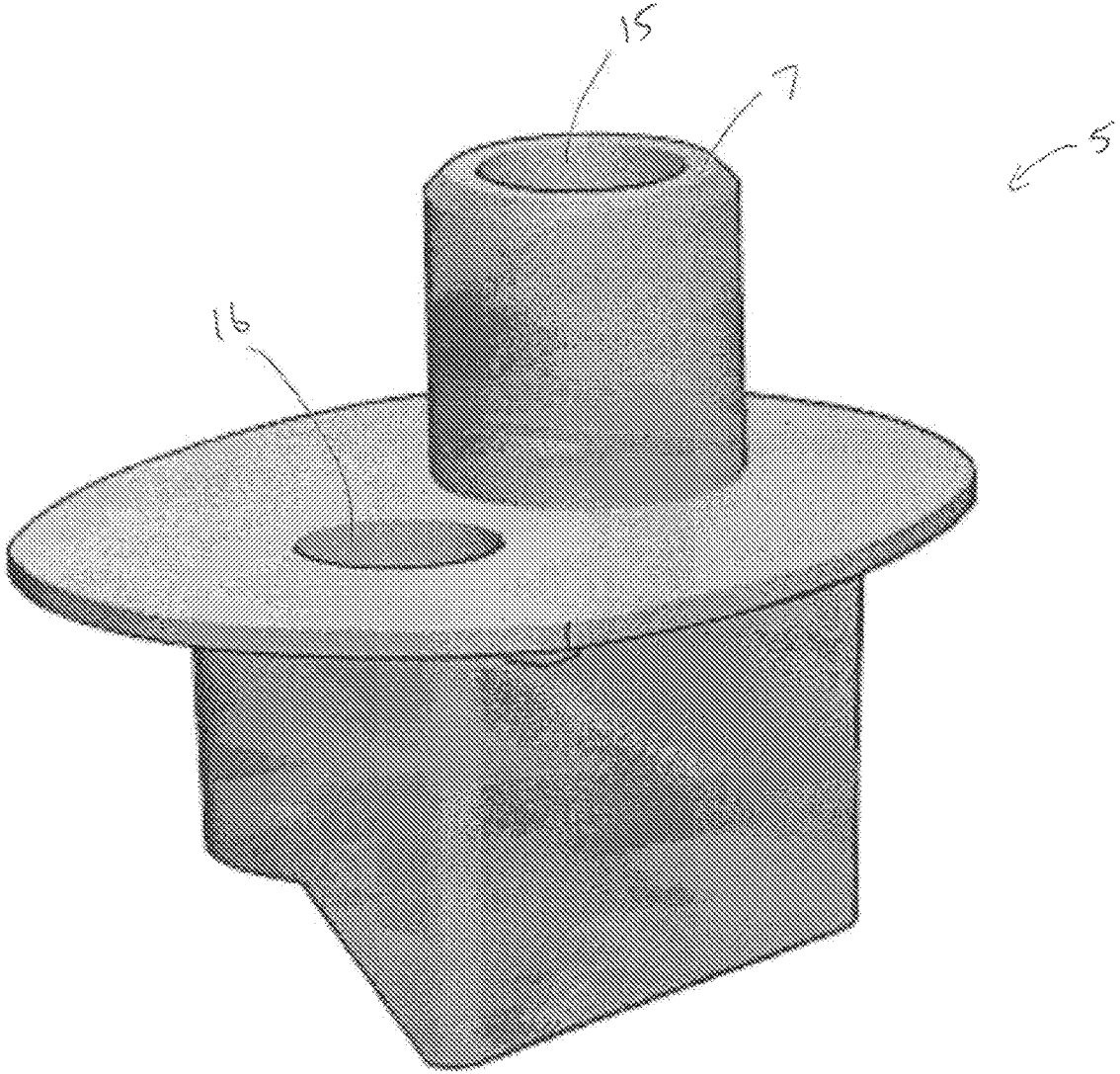
FIG. 5*a* shows a perspective view of the top of the support member of the present invention.
Figure 5B:
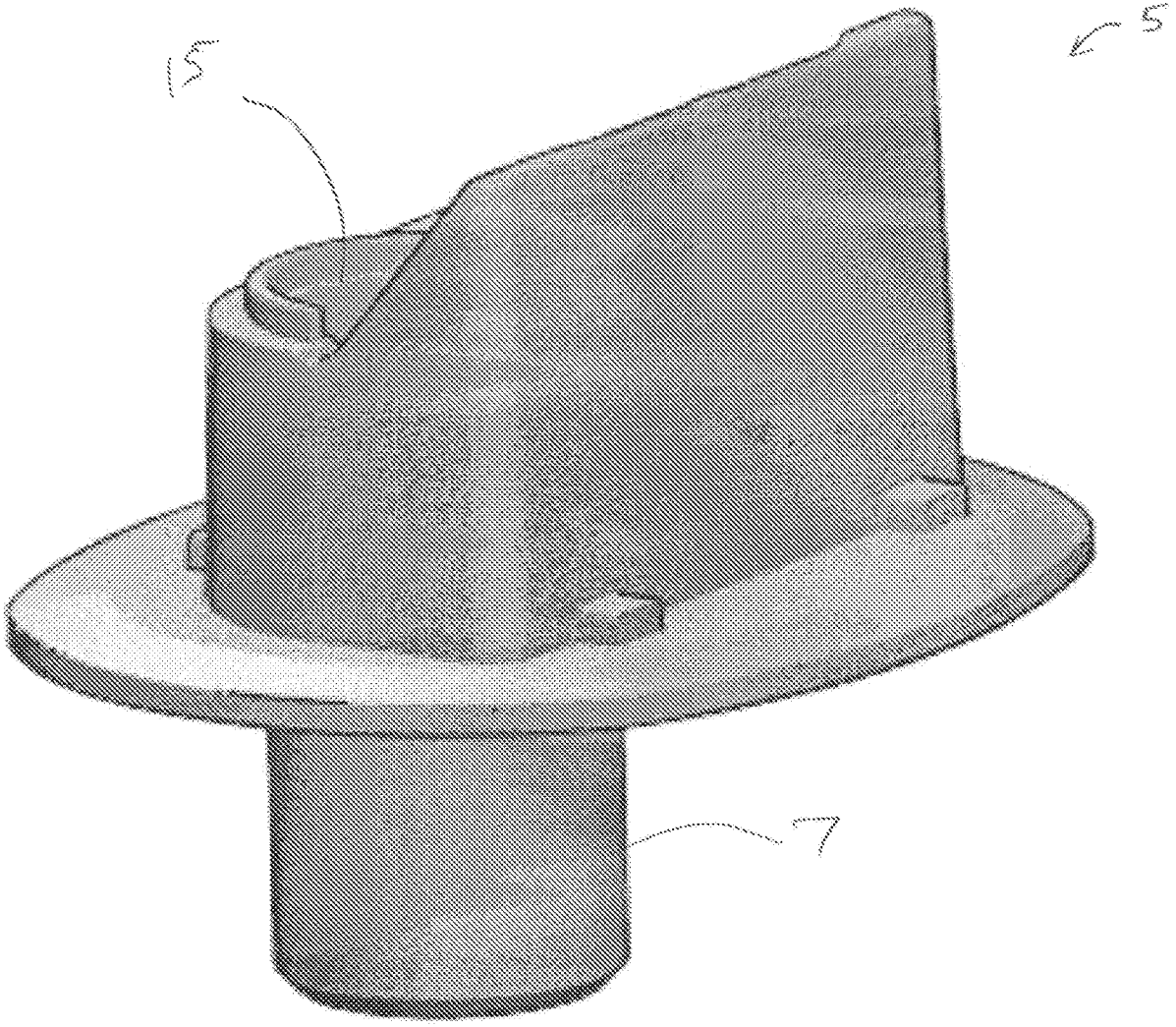
FIG. 5*b* shows a perspective view of the bottom of the support member of the present invention.

FIGS. 5*a* and 5*b* show the perspective views of the top and bottom of the support member 5 respectively. As can be seen from FIG. 5*a*, the support member has two through-holes 15, 16 in its upper surface. The first through-hole 15 extends through the support member 5 and receives the electrical connection port 27. The second through-hole 16 is configured for receiving the valve 2 which forms part of the plate 1.

As can be seen from FIG. 5*b*, the support member 5 is asymmetrical in that it has one side longer than the other. The longer side provides the maximum adhesion surface for the battery 3 on the support member 5. The opposing side on which the circuit board is attached is smaller, thus reducing the weight of the apparatus.

Figure 5C:
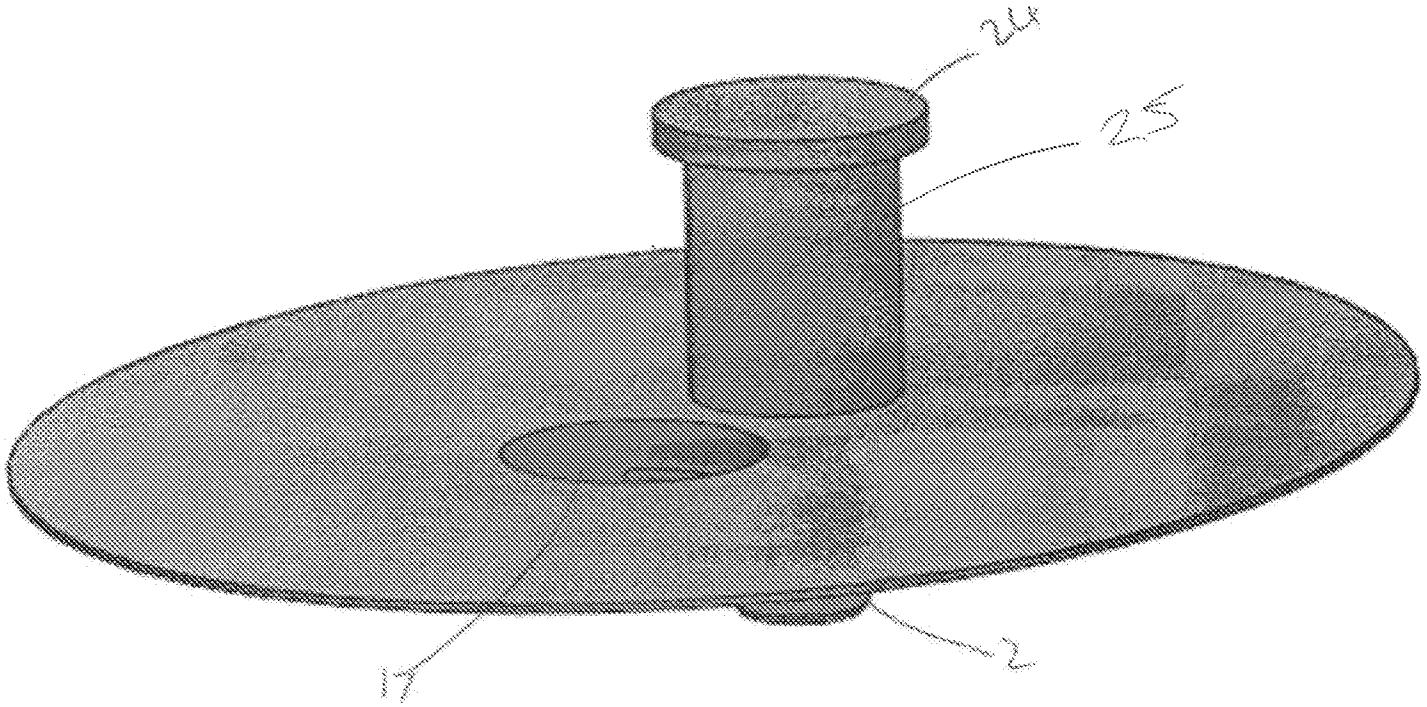
FIG. 5*c* shows a perspective view of the bottom of the plate and valve of the present invention.

FIG. 5*c* shows a bottom perspective view of the plate 1 and valve access port 2 arrangement. As can be seen from this figure, a lower part of the valve extends below the plate and ends with the lip 24. The lip 24 is formed of a flexible material such as rubber so is able to deform to fit into and through the through-hole 16. When the support member 5 is attached to the plate 1, the lip 24 is forced into the through-hole 16 and pushed through until the lip 24 extends outside the support member 5. The technician is able to know when this position has been reached since it is not possible to remove the valve easily from the through-hole 16 at this point as the protruding surface of the lip sits on the lower surface of the support member 5. This was shown previously in FIG. 2.

The plate 1 additionally comprises an opening 17 in its surface which is configured to receive the resilient collar 7 provided on the support member 5.

As is discussed above, a rugby ball comprises an inner inflatable bladder and an outer cover. The outer cover is often made up of a plurality of panels, for example four. The panels are connected at seams where they are stitched together. In the present example, the extruded portion 11 of the plate 1 is attached to the cover by adhesive.

The apparatus of the present invention is attached in between two of the panels of the outer cover, at a seam. It is located substantially halfway between the two ends of the ovoid rugby ball. The outer cover is folded into the first elongate groove 8 of the plate.

When the apparatus is installed in a rugby ball, the position of the ball can be tracked within a nominated space, for example within a training field or stadium. This is done by the circuit board 4 transmitting radio signals to various receivers. The battery powers the transmitter so that it can transmit the signals. The signal may be transmitted using ultra-wideband (UWB). This technology enables the position of the ball to be recorded accurate to between 20 and 40 cm. UWB uses very low energy thus reducing the required regularity for charging the battery.

The battery is charged by connecting the electrical connection port 27 to a power source. This also enables software updates of the circuit board to be carried out.

When the apparatus of the present invention is installed in another type of inflatable ball, for example a round ball such as a football or a netball, a more even weight balance is required. In these applications, the weight of the apparatus may be reduced and the weight balancing arrangement be designed to have a weight equal to that of the reduced weight valve.

Figure 6:
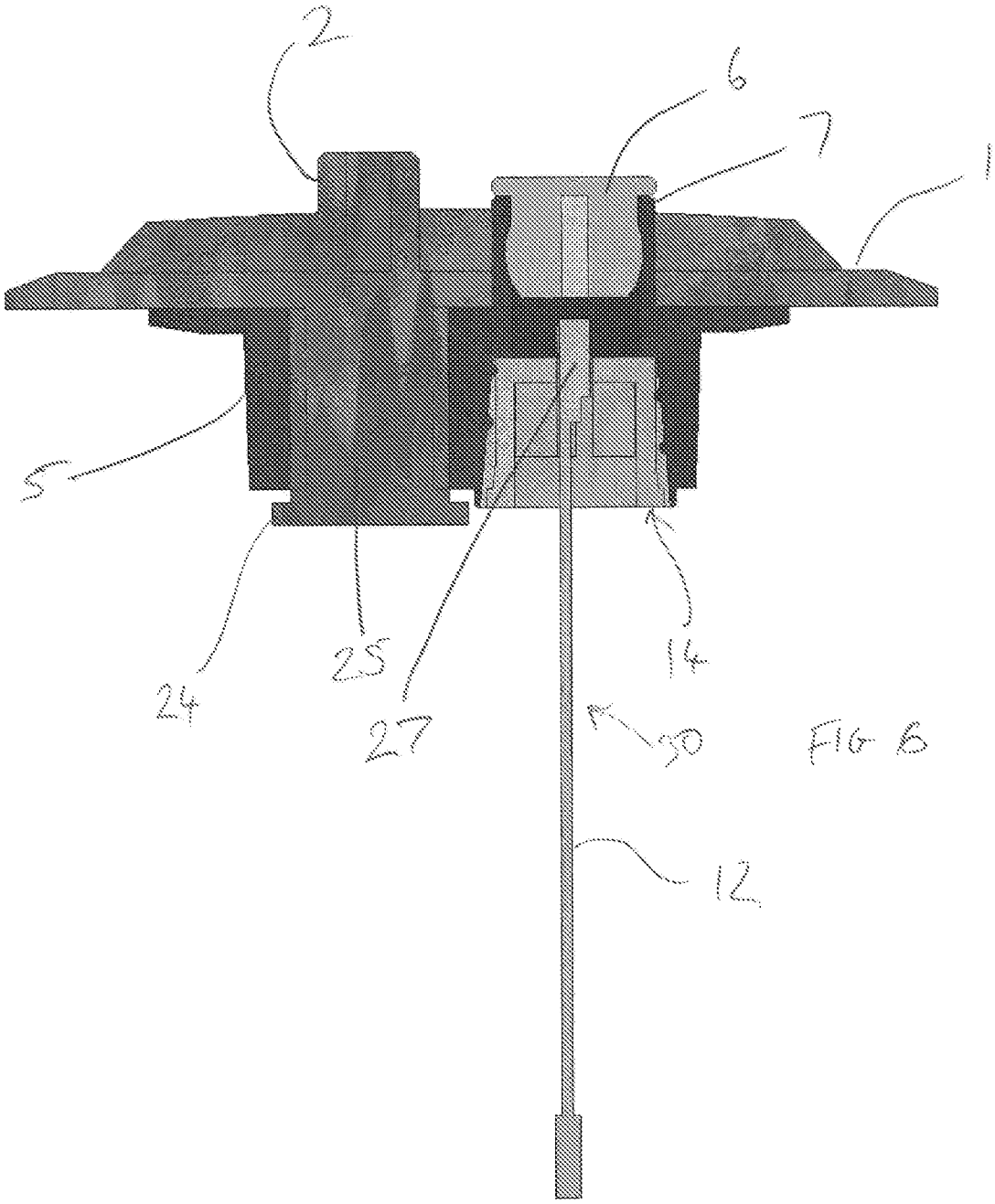
FIG. 6 shows a cross-sectional view of another embodiment of an apparatus according to the invention.

FIG. 6 shows a cross section through another apparatus according to the invention. Here it can be seen the structure of the electrical connection port assembly 30 that is received by the first through-hole 15, and the sealing arrangement provided by the resilient collar 7 and the bung 6 in combination. These features will be described in more detail with respect to FIGS. 7 to 9*b*.

Figure 7:
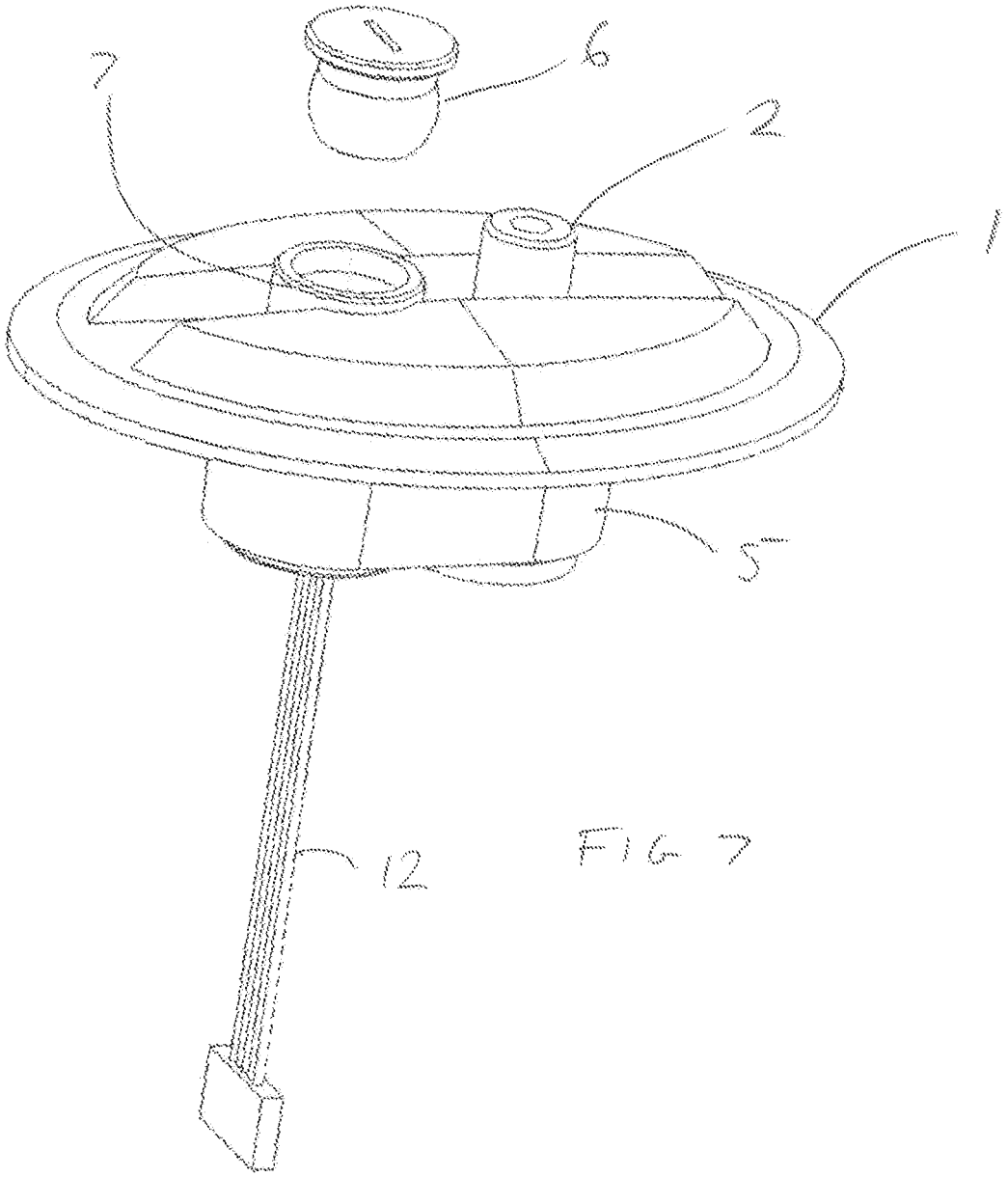
FIG. 7 shows a perspective view of an embodiment of an apparatus according to the invention.
Figure 8:
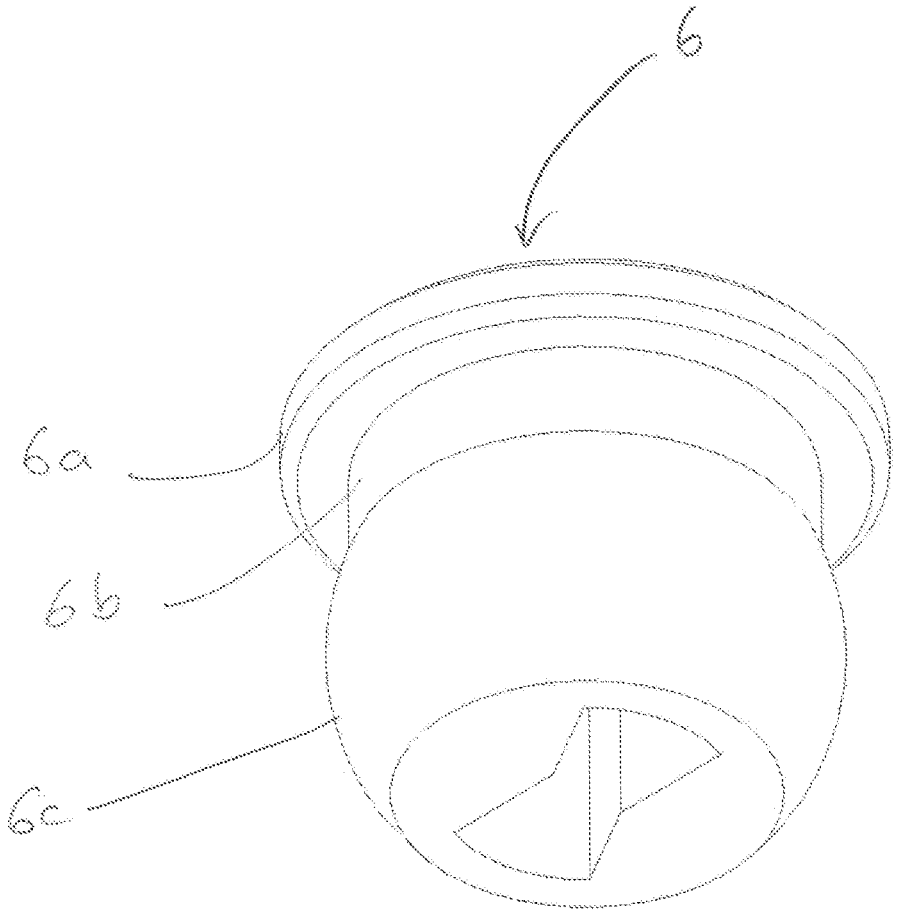
FIG. 8 shows a lower perspective view of a bung used in an embodiment of the apparatus according to the invention.

FIG. 7 shows the apparatus shown in FIG. 6, but with the bung 6 removed from the resilient collar 7, through which the electrical connection port 27 may be accessed. FIG. 8 shows the bung in more detail.

As can be seen in particular in FIG. 8, the bung 6 comprises a flat top 6*a* connected by a narrower neck 6*b* to a bulbous lower portion 6*c* of the bung 6. When this bung is inserted into the resilient collar 7, which has a substantially cylindrical shape, the bulbous lower portion 6*c*, which has a larger diameter than the inner diameter of the resilient collar, presses outwards against the inside wall of the resilient collar. This causes the upper opening of the resilient collar to constrict about the neck 6*b* of the bung, which forms a tight seal for preventing ingress of materials into the connection port 27.

Figure 9A:
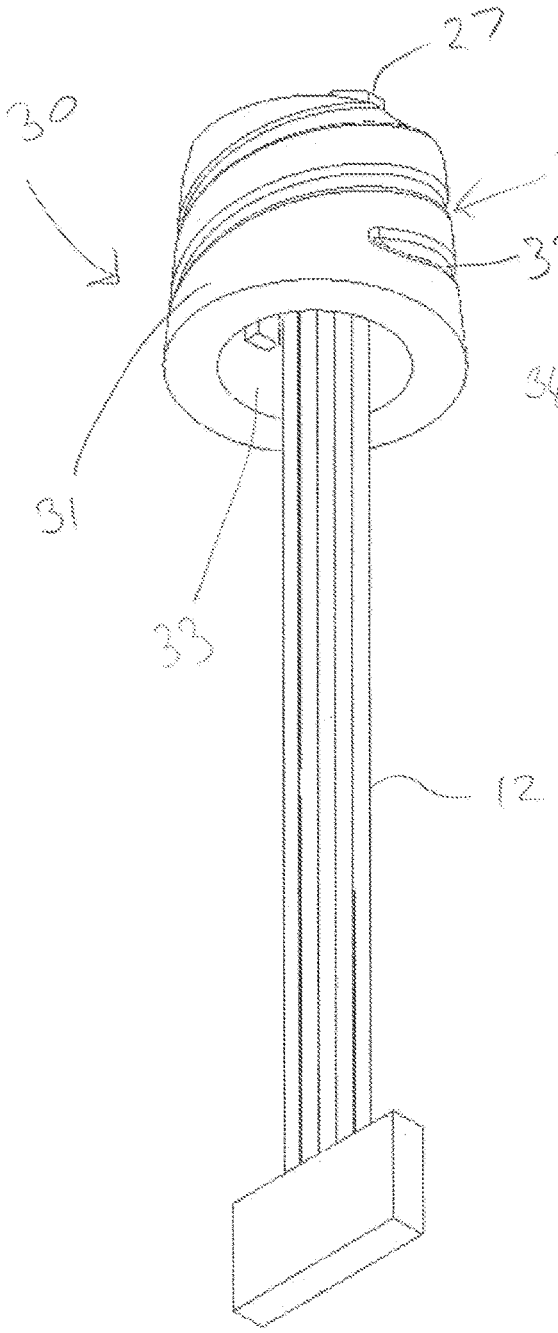
FIGS. 9*a* and 9*b* show upper and lower perspective views of a electrical connector assembly for use in an embodiment of the apparatus of the present invention.
Figure 9B:
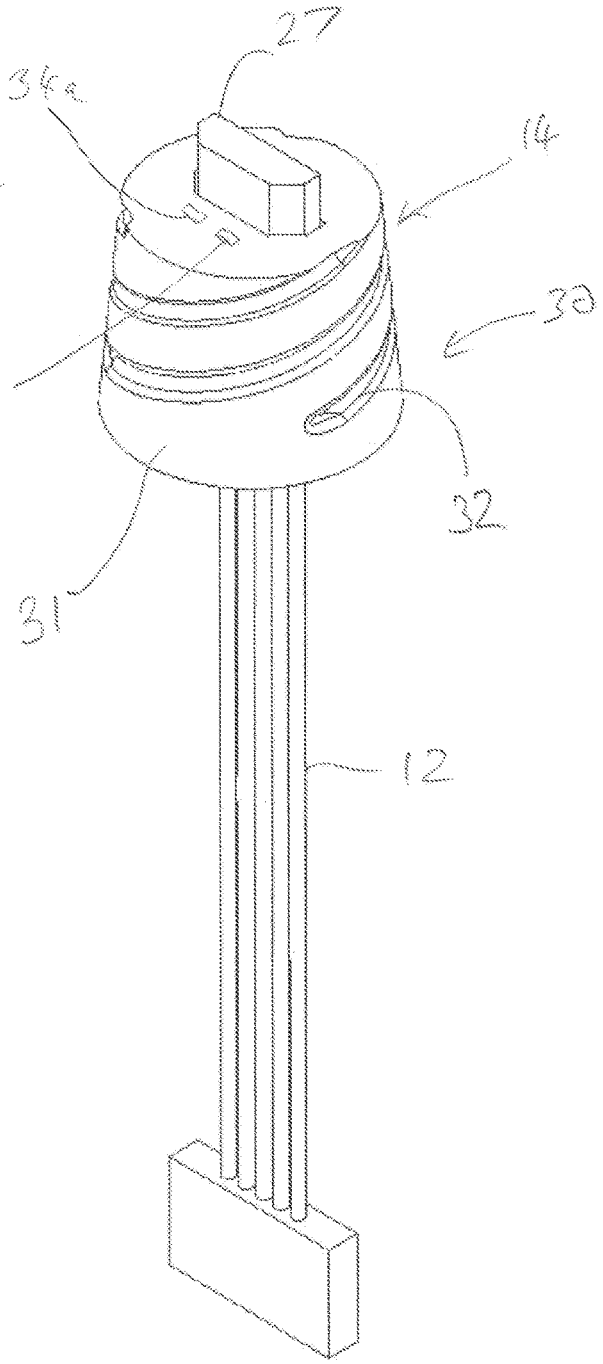

FIGS. 9*a* and 9*b* show the electrical connector assembly 30 in more detail. As shown in these figures, the assembly comprises the plug member 14, through an opening of which the electrical connector port 27 is exposed, and from the rear of which the first wire 12 extends for connecting to other internal electronics of the ball.

The plug member 14 comprises a generally frustoconical head 31 that defines sidewalls that taper outwards as they extend away from the connection port 27 towards the interior of the ball. These sidewalls also define a helical groove 32 that extends around the entire circumference of the head 31. These grooves are used to retain adhesive when the plug member is inserted into the first aperture and to thereby promote adhesion.

FIG. 9*a* shows that the rear face of the head 31 defines an opening. This opening may be backfilled with a sealant to ensure that air cannot escape from the ball via the connector 27.

FIG. 9*b* shows that the forward face of the head 31 includes two windows 34*a*, 34*b* that may reveal LEDs for indicating to a user that data transfer is in progress or that charging is in process, when an appropriate cable has been connected to the electrical port 27.

The invention claimed is:

1. An apparatus for permitting electrical connection between the exterior of an inflatable sports ball and electronics located inside the inflatable sports ball, the apparatus comprising:

a support member, the support member having separate first and second through-holes provided therein for respectively connecting the exterior of the inflatable sports ball with the interior of the inflatable sports ball;

an electrical connection port located in the first through-hole of the support member for permitting an electrical connection to be made through the first through-hole; and an air valve located in the second through-hole of the support member, the air valve comprising an aperture for selective communication of air;

the electrical connection port is carried by an electrical connector assembly adapted for insertion into the first through-hole, the electrical connector assembly comprising a plug member configured for insertion into the first through-hole, the plug member comprising an opening through which the electrical connection port is exposed inside the first through-hole; wherein the plug member comprises a first face carrying the opening through which the electrical connection port is exposed inside the first through-hole, the first face being no larger than the first through-hole, and a second face substantially opposite the first face, the second face being larger than the first through-hole such that the plug member cannot pass through the first through-hole.

2. An apparatus according to claim 1, wherein the first and second through-holes of the support member are defined by a single unitary element.

3. An apparatus according to claim 1, wherein the electrical connection port is recessed into the first through-hole with respect to the exterior side of the first through-hole.

4. An apparatus according to claim 1, wherein the support member comprises a peripheral flange encompassing the first and second through-holes for attaching the support member to an inner inflatable bladder of the inflatable sports ball or an outer cover of the inflatable sports ball.

5. An apparatus according to claim 1, wherein the electrical connector assembly is arranged in the first through-hole and backfilled with a sealant to provide an air-tight seal of the first through-hole.

6. An apparatus according to claim 1, further comprising one or more visual indicators, located in the first through-hole for conveying information as regards data transfer with or charging of electronics located inside the inflatable sports ball or status of a connection to a wireless network.

7. An apparatus according to claim 1, wherein the electrical connection port comprises a USB port, a mini-USB port, a micro-USB port, or a USB Type-C port.

8. An apparatus according to claim 1, wherein the first through-hole connects to a resilient collar on the exterior side of the first through-hole, and wherein the apparatus further comprises a bung for inserting into the resilient collar so as to prevent ingress of materials into the electrical connection port.

9. An apparatus according to claim 8, wherein the bung comprises a bulbous end for insertion into the resilient collar, the bulbous end thereby causing the opening of the resilient collar to tighten around the bung.

10. An apparatus according to claim 1, further comprising a battery located on the support member.

11. An apparatus according to claim 10, wherein the support member defines at least a first supporting wall and a second supporting wall, the first and second supporting walls supporting first and second faces of the battery.

12. An apparatus according to claim 10, wherein the support member comprises a pocket in which the battery is located.

13. An inflatable sports ball comprising:

an outer cover defining the exterior of the inflatable sports ball;

electronics located inside the outer cover; and the apparatus according to claim 1 adapted to permit electrical connection between the exterior of the inflatable sports ball and the electronics located inside the outer cover.

14. An inflatable sports ball according to claim 13, further comprising an inner inflatable bladder encased in the outer cover and configured to be inflated through the air valve, wherein the electronics are located inside the inner inflatable bladder.

15. An inflatable sports ball according to claim 13, wherein the electronics comprise one or more of MEMS sensors a microcontroller, flash memory, power management unit, battery monitoring unit and wireless communication unit.

16. An apparatus for permitting electrical connection between the exterior of an inflatable sports ball and electronics located inside the inflatable sports ball, the apparatus comprising:

a support member, the support member having separate first and second through-holes provided therein for respectively connecting the exterior of the inflatable sports ball with the interior of the inflatable sports ball;

an electrical connection port located in the first through-hole of the support member for permitting an electrical connection to be made through the first through-hole; and an air valve located in the second through-hole of the support member, the air valve comprising an aperture for selective communication of air;

the electrical connection port is carried by an electrical connector assembly adapted for insertion into the first through-hole, the electrical connector assembly comprising a plug member configured for insertion into the first through-hole, the plug member comprising an opening through which the electrical connection port is exposed inside the first through-hole; wherein the plug member comprises tapering sidewalls for engaging the inside walls of the first through-hole, the sidewalls tapering outward as they extend away from the opening through which the electrical connection port is exposed.

17. An apparatus for permitting electrical connection between the exterior of an inflatable sports ball and electronics located inside the inflatable sports ball, the apparatus comprising:

a support member, the support member having separate first and second through-holes provided therein for respectively connecting the exterior of the inflatable sports ball with the interior of the inflatable sports ball;

an electrical connection port located in the first through-hole of the support member for permitting an electrical connection to be made through the first through-hole; and an air valve located in the second through-hole of the support member, the air valve comprising an aperture for selective communication of air; wherein the first through-hole connects to a resilient collar on the exterior side of the first through-hole, and wherein the apparatus further comprises a bung for inserting into the resilient collar so as to prevent ingress of materials into the electrical connection port.

* * * * *